United States Patent [19]

Anderson et al.

[11] 4,112,731

[45] Sep. 12, 1978

[54] LIGHT GAUGE SHEET METAL FORMING MACHINE

[75] Inventors: Leroy E. Anderson; David V. Charlson; Mark A. Vierkant, all of Detroit Lakes, Minn.

[73] Assignee: Manufacturers Systems, Inc., Detroit Lakes, Minn.

[21] Appl. No.: 761,801

[22] Filed: Jan. 24, 1977

[51] Int. Cl.[2] ..... B21D 5/04

[52] U.S. Cl. ..... 72/320; 72/478; 72/481

[58] Field of Search ..... 72/319, 320, 322, 323, 72/469, 478, 480, 481

[56] References Cited

U.S. PATENT DOCUMENTS

| | | | |
|---|---|---|---|
| 929,818 | 8/1909 | Benedek | 72/319 |
| 1,935,173 | 11/1933 | Anthony et al. | 72/319 |
| 2,283,012 | 5/1942 | Nightingale | 72/319 |
| 3,326,032 | 6/1967 | Stuhldreher | 72/481 |
| 3,359,771 | 12/1967 | Meyerchick | 72/319 |
| 3,359,772 | 12/1967 | Fillip | 72/319 |
| 3,786,666 | 1/1974 | York | 72/320 |
| 3,948,074 | 12/1974 | Stalzer | 72/319 |

*Primary Examiner*—Michael J. Keenan

*Attorney, Agent, or Firm*—Schroeder, Siegfried, Ryan, Vidas & Steffey

[57] ABSTRACT

A semi-automatic sheet metal forming machine for forming light gauge metal having a bed formed of a plurality of adjustable and interchangeable spaced spacer plates of various widths, a forming bar having a plurality of removable and interchangeable forming fingers of various widths, and a clamping bar including a plurality of removable slidably mounted clamping fingers of various widths, the clamping bar and forming bar being hydraulically operated and synchronized for semi-automatic repeated forming operations. By adjusting and utilizing different width combinations of the clamping and forming fingers and spacer plates, an operator can perform almost any desired sheet metal forming operation which heretofore would have required separate and expensive special dies.

24 Claims, 16 Drawing Figures

Fig. 3
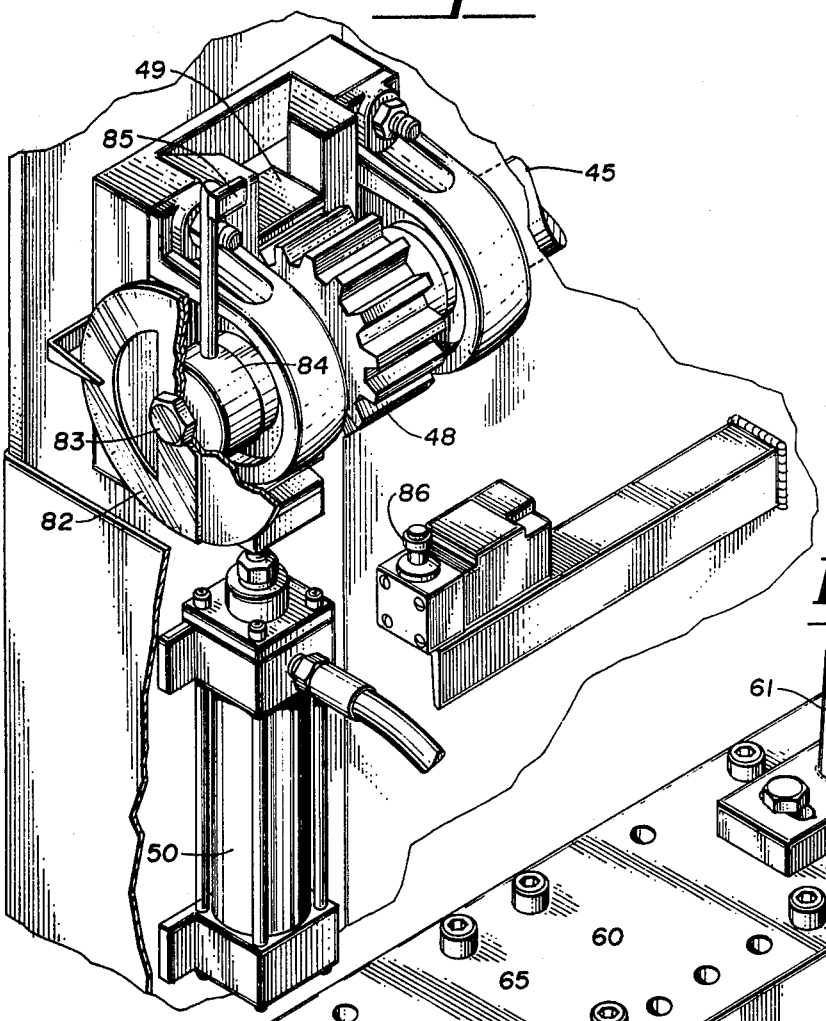
Fig. 4
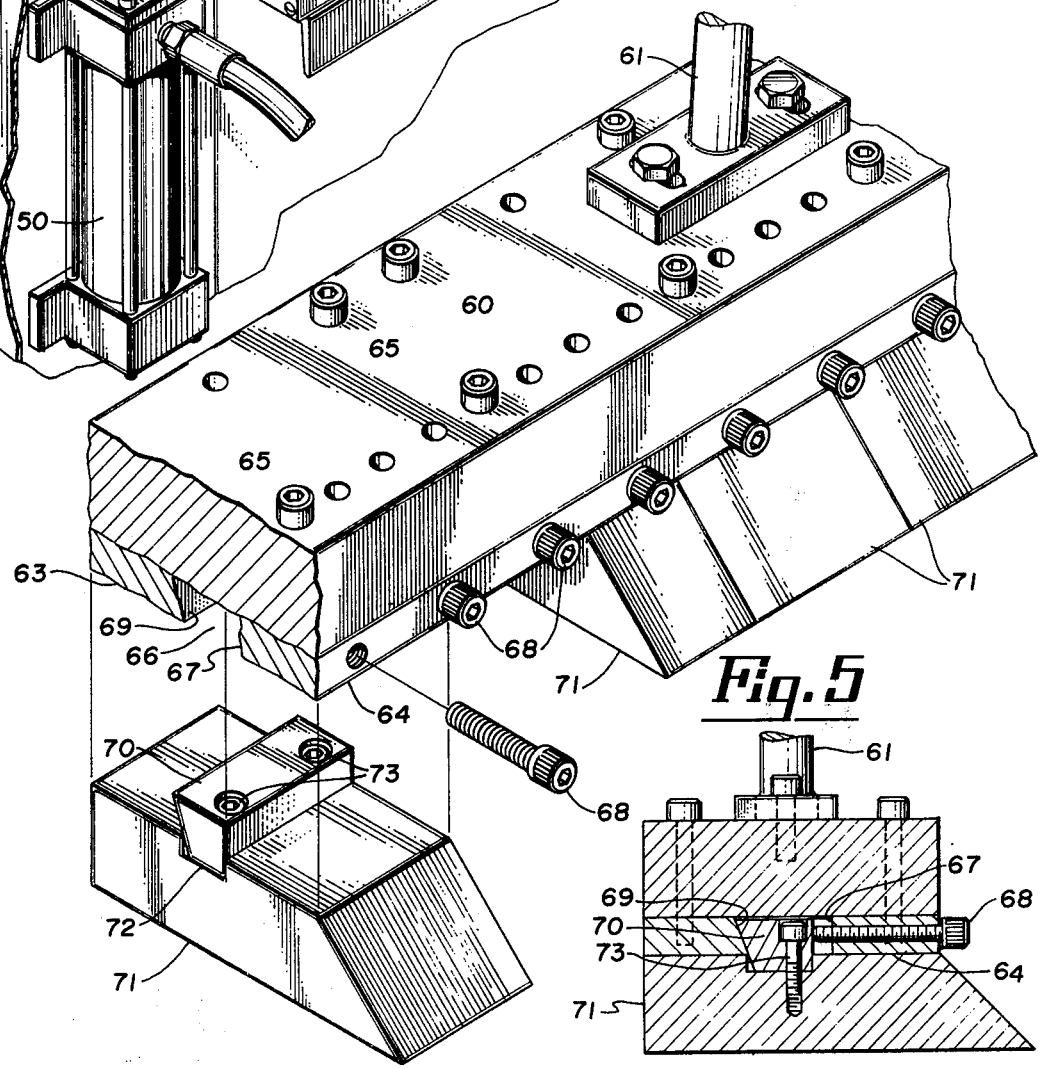
Fig. 5

LIGHT GAUGE SHEET METAL FORMING MACHINE

It is a general object of our invention to provide a novel and improved sheet metal forming machine.

A more specific object is to provide a novel and improved sheet metal forming machine constructed and arranged to obviate the need for most, if not all, special dies heretofore required to perform out of the very ordinary sheet metal forming operations.

A still more specific object is to provide a novel and improved sheet metal forming machine having removable and interchangeable clamping fingers, forming fingers, and/or bed spacer plates to enable the operator to produce many forms frequently needed by which otherwise require specially constructed dies.

Another object is to provide a novel and improved sheet metal forming machine which is semi-automatic and has much greater versatality than other machines heretofore used for such purposes.

These and other objects and advantages of our invention will more fully appear from the following description, made in connnection with the accompanying drawings, wherein like reference characters refer to the same or similar parts throughout the several views, in which:

FIG. 3 is a detailed perspective view on an enlarged scale of a portion of our machine with portions thereof broken away and showing the operating mechanism for causing the forming bar to swing between retracted and forming position and for limiting the extent of such a swing, the 135° control switch having been omitted for sake of clarity;

FIG. 4 is a detailed perspective view on an enlarged scale of another portion of our machine illustrating the construction and assembly of the clamping bar, including the clamping fingers and means for interchanging, adjusting and securing the same;

FIG. 5 is a vertical sectional view taken through the clamping bar of our machine and illustrating the means for mounting the clamping fingers upon the remainder of the clamping bar and for securing the mounting bar within the clamping bar channel;

Figures 1, 2:
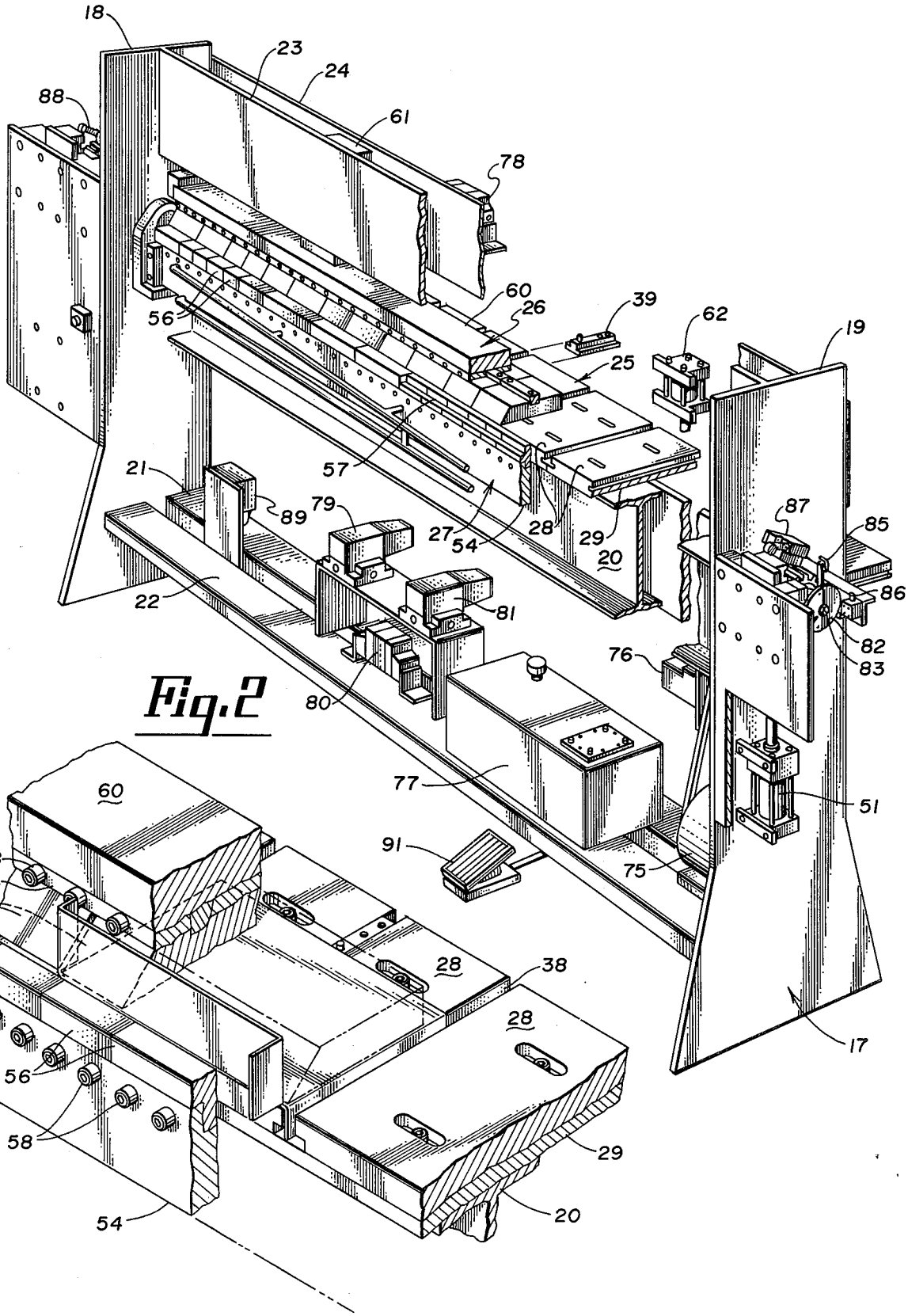
FIG. 1 is a perspective view of an embodiement of our invention with portions thereof broken away to better illustrate the construction thereof.
FIG. 2 is a detailed perspective view on an enlarged scale with portions broken away of an illustration of the construction of the bed, the clamping bar, and the forming bar of our machine.
Figure 6:
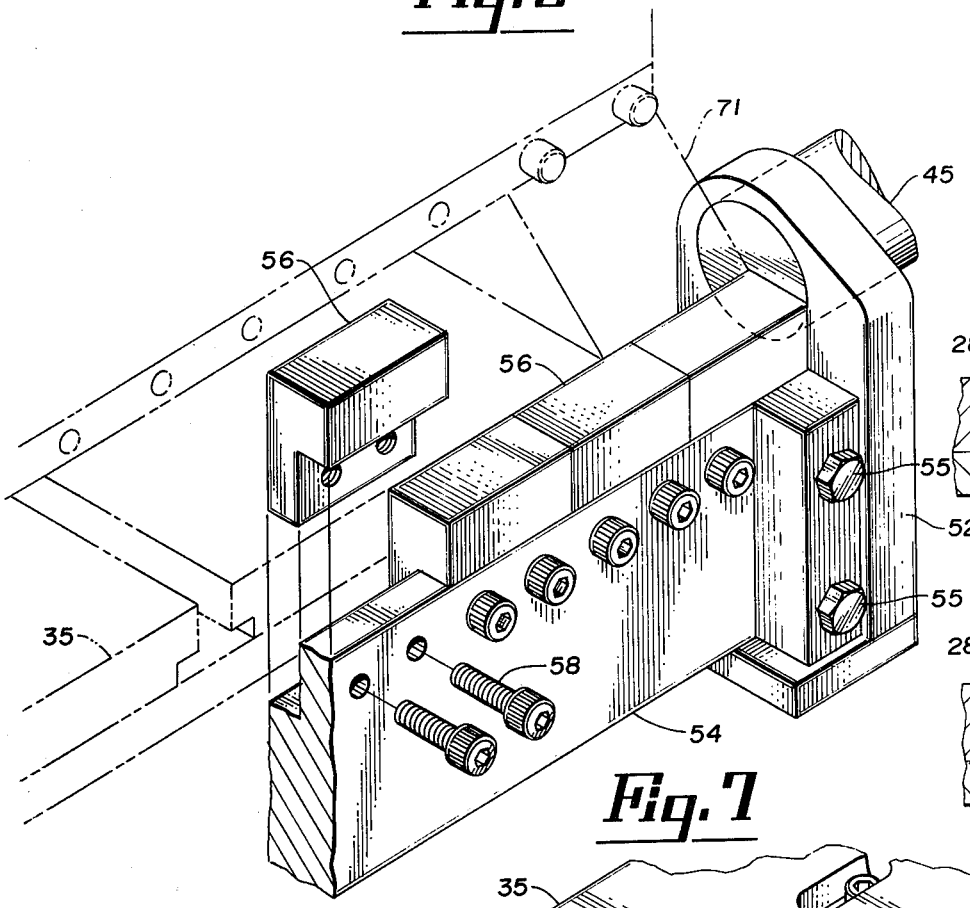
FIG. 6 is a detailed perspective view on an enlarged scale of a portion of the forming bar of our machine with parts broken away to better illustrate the construction and manner of attaching and interchanging the forming fingers.
Figure 8:
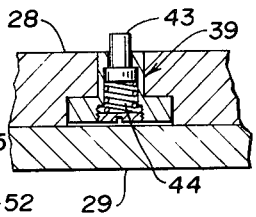
FIG. 8 is a vertical sectional view taken through the bed guage shown in FIG. 7 along approximately line 8—8 when the abutment post of the guage is not depressed.

One embodiment of our invention, as shown in FIGS. 1–16, inclusive, may include a frame indicated generally by the numeral 17 having end support members 18 and 19, between which an I-beam 20 extends. Lower cross support members 21 and 22 and upper cross support members 23 and 24 also extend between the end members 18 and 19, as best shown in FIG. 1. The three principal elements of the machine include the bed, indicated generally by the numeral 25, the clamping bar, indicated generally by the numeral 26, and the forming bar, indicated generally by the numeral 27.

Figure 7:
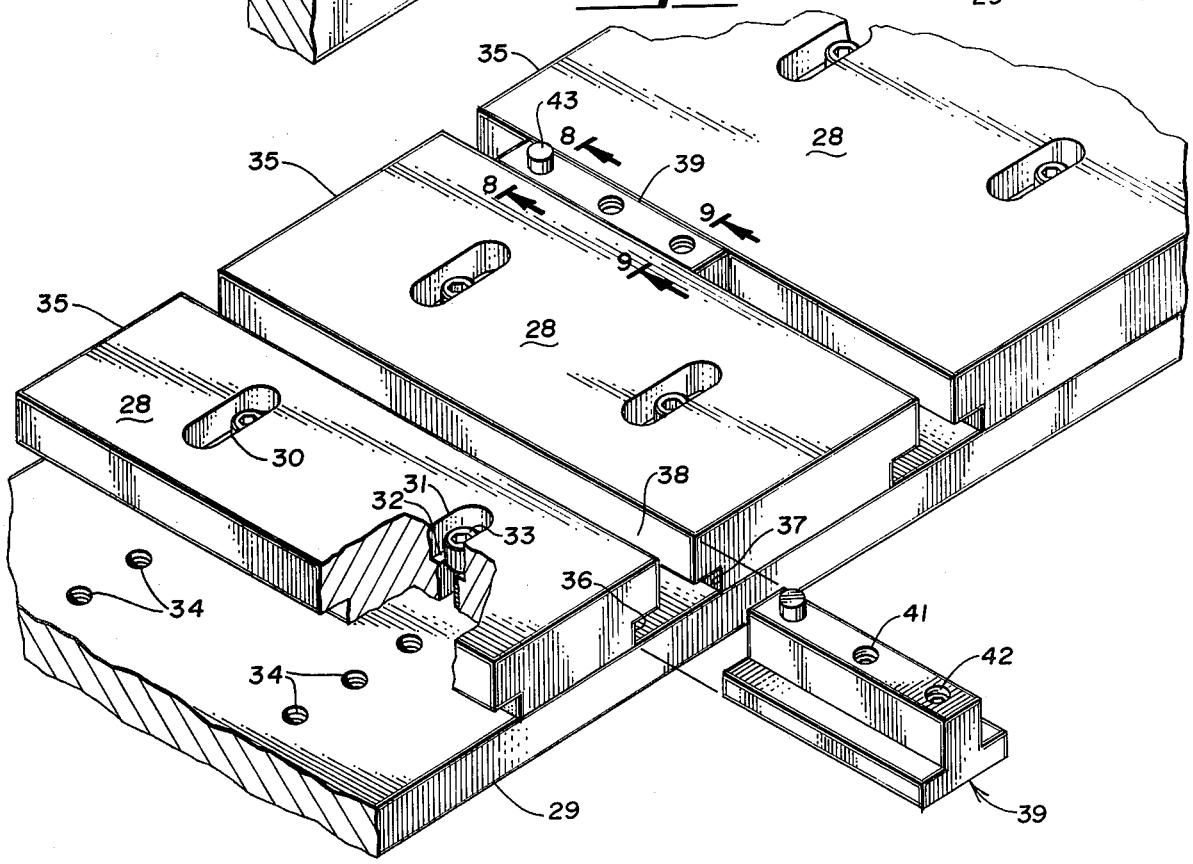
FIG. 7 is a detailed perspective view on an enlarged scale of a portion of the bed of our machine with parts thereof broken away to better illustrate the adjustment and interchange of the bed spacer plates, channel formed therebetween, and bed guage.

The bed 25 is comprised of a plurality of spacer plates 28, which are mounted upon a horizontal plate 29, which is fixedly mounted between the end support 18 and 19 and supported by the I-beam 20. These spacer plates 28 are of various different widths, as best shown in FIG. 7, and they are provided with a pair of longitudinally spaced vertical openings, or slots, 30 and 31. Each of these slots is counter-bored to provide a shoulder 32 upon which socket cap screws indicated by the numeral 33 bear when threaded into one of the openings 34 form in the plate 29 along a line and spaced 2 inches apart, center-to-center. The slot 31 is elongated to permit the spacer plates 28 to be shifted laterally between the predetermined limits defined by the length of the slot 31. These spacer plates 28 are interchangeable and have foward upper transverse edges which define a breaker line 35 about which the sheet metal is formed when the machine operates.

Each of the spacer plates 28, as shown in FIG. 7, has its lower longitudinal edge relieved as at 36 and 37 so that when the spacer plates are secured, as shown in FIG. 7, they are spaced slightly relative to each other and define in inverted T-shaped slots 38 therebetween.

Figure 9:
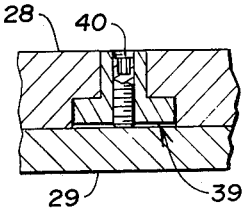
FIG. 9 is a fragmentary vertical sectional view taken of the same bed guage when the abutment post has been depressed by the clamping bar.

A bed guage 39 is provided for use in the slot 38 to provide a ready means for gauging the extent to which the metal should be extended beyond the break line 35. As shown in FIG. 7, the bed guage 39 is T-shaped in cross-sectional configuration to conform in shape and dimensions with the slot 38 so that it may be slidably received within the latter and positioned wherever desired along the length of the slot. The position of the guage 39 can be maintained by tightening socket cap screws 40 which are threadedly received in each of the threaded openings 41 and 42, as best shown in FIG. 9, the cap screws bearing against the bottom of the channel 38 and clamping the bed guage 39 upwardly against the underside of the adjacent spacer plates 28. A spring loaded abutmet post 43 (FIG. 8) is carried by the bed guage 39 and provides an abutment against which a piece of sheet metal may be placed so as to cause the break to be formed at the desired line on the piece of metal. When the bed guage is positioned between a pair of spacer plates 28, as shown in FIG. 7, the post 43 which is urged upwardly by the spring 44 extends upwardly above the spacer plates 28 to serve as an abutment for the piece of sheet metal until the clamping bar descends and grips the sheet of metal at the desired position. When this takes places, the spring 44 is compressed and the post 43 is pressed downwardly to a retracted position within the bed guage 39.

The forming bar 27 includes a pair of form bar stub shafts 45 and 46 which are rotatably mounted upon the end supports 18 and 19 in a pillow block 47 which is mounted upon the frame as shown in FIG. 3. The axis of pivot of the two shafts 45 and 46 is the breaker line 35. Each of the shafts 45 and 46 carries and is rotatably driven by a spur gear 48 which in turn is actuated by a vertically extending and vertically movable gear rack or rack lift 49, as best shown in FIG. 3. Each of these gear racks 49 is driven by one of a pair of cylinders 50 or 51 which are mounted upon the frame immediately therebelow and is connected to the lower end of the gear rack 49 by its piston. Each of these pistons are of the double-ended type and are capable of positively driving the gear rack in either direction vertically so as to rotate the shafts 45 and 46 as desired.

Mounted upon each of the shafts 45 and 46 is an L-shaped pivot arm 52, 53, respectively. These pivot arms swing with the shaft and support an elongated transverse mounting bar 54 which is capable of adjustment by means of the adjustment bolts 55. This mounting bar 54 mounts a plurality of forming fingers, one type of which is shown in detail in FIG. 6 and identified by the numeral 56, and a second type of which is shown in FIG. 1 and is identified by the numeral 57. These forming fingers are of various widths and each is secured to the mounting bar by means of socket cap screws 58 which extend through the forming bar 54 and thread into the apertures provided therefor in the forming fingers. The apertures in the mounting bar 54 through which the cap screws 58 extend are formed along two inch centers. The upper transverse edge of each of the forming fingers adjacent the break line is disposed on the axis of pivot of the form bar shafts 45 and 46 so that when the form bar 27 swings upwardly, the upper inner edge of the forming fingers will move around the break line and the forward edge of the clamping fingers to be hereinafter described.

The clamping bar 26 includes an elongated transversely extending bar 60 which is carried by and moved upwardly and downwardly by the pistons of a pair of hydraulic cylinders 61 and 62 which are mounted upon the cross supports 23 and 24. These pistons move the clamping bar 60 between raised non-clamping position to lowered clamping position relative to the bed 25. As best shown in FIG. 4, a pair of elongated mounting plates 63 and 64 are secured to the underside of the bar 60 by means of cap screw 65 and define a channel 66 therebetween. One side wall of the channel 66 is formed by the vertical side 67 of the mounting plate 64 through which securing means in the form of socket cap screws 68 extend into the channel 66. The opposite side wall of the channel 66 is defined by one side 69 of the mounting plate 63 and, as shown in FIGS. 4 and 5, extends upwardly from the lower edge and away from the securing means 68 to provide a beveled wall against which mounting block 70 of a clamping finger 71 may bear. It will be seen by reference to FIGS. 4 and 5 that each of the mounting blocks 70 has a correspondingly beveled rear side and is secured within a channel 72 provided for that purpose in the clamping finger, by means of socket cap screw 73. The forward end of each of the clamping fingers 71 is tapered upwardly and rearwardly at approximately 45° angles.

It will be seen that the clamping fingers 71 are of various different widths and are readily adjustable longitudinally of the channel 66 and the slidable therewithin when the securing means 68 is released. The maximum width of each of the mounting blocks 70 is less than the minimum width of the channel 66 so that the clamping fingers 71 may be readily removed when the cap screws 68 are drawn from the channel 66. The clamping fingers 71 are of such dimensions and are so constructed and arranged relative to the bar 60 that the forward edges thereof extend along the break line 35 when the clamping bar 26 is moved into clamping position by extension of the cylinders 61 and 62. Thus, when the forming bar 27 is swung into forming position, it swings around the break line 35 and the forward end of the clamping fingers 71. Since the clamping fingers are readily slidable longitudinally of the channel 66 and the securing means 68 merely serves to clamp the mounting block against the rear sloping wall 69, substantially universal adjustment is available, with the result that a clamping member of substantially any desired width can be readily provided merely by selecting the correct combination of clamping fingers of different widths and mounting them within the channel 66 at the desired location along its length.

Mounted upon the frame 17 for the purpose of driving the machine is a motor 75 which drives hydraulic pump 76 which is connected by conduits to a tank 77 of hydraulic fluid. The pump 76 pumps fluid into a flow divider 78 through which the hydraulic fluid is supplied to a valve 79 which controls the flow to the pair of cylinders 61 and 62 which, as previously described, move the clamping bar 26 between non-clamping and clamping positions. The outlet of the pump 76 is likewise connected through a flow divider 80 with a hydraulic solenoid valve 81 which controls the flow of hydraulic fluid through conduits provided for that purpose to the cylinders 50 and 51.

Mounted on the outer end of the forming bar pivot shaft 45 is an angle indicator 82 which is best shown at FIGS. 1 and 3 and which can be adjusted by loosening the angle indicating adjustment bolt 83 and then rotating the indicator relative to the shaft 45 to the desired setting. Secured to the shaft 45 by means of a sleeve 84 fixedly secured thereto is an outwardly extending angle limiting switch actuator pad 85 which is positioned so as to engage angle limiting switch 86 once the shaft 45 has turned throughout the arc for which the indicator 82 was set. The switch 86 functions to deactivate valve 81 and thereby cause the flow of hydraulic fluid to pass to the opposite ends of the cylinders 50 and 51 and thereby cause the forming bar 27 to return to its non-forming position.

Also carried by the shaft 45 is a normally open 90° control microswitch 87 which is moved to closed position as the shaft 45 moves beyond a position 90° from its original non-forming position. Closing of this switch prevents, as will hereinafter be described, the clamping bar 26 from being elevated by the cylinders 61 and 62, with consequent serious damage to the machine. Once the shaft 45 has returned to a position of less than 90° from its original non-forming position, the switch 87 will automatically return to its normally open position and hence thereafter the clamping bar 26 is free to be elevated by its controlling cylinders.

Mounted on the pivot shaft 46 at the opposite end of the machine is a 135° control switch 88 which is a microswitch normally in closed position. This switch is positioned so as to move same to open position if and when the forming bar 27 is swung to a position beyond 135° from its original retracted position. The purpose of this switch is to preclude serious damage to the machine in the event of a malfunction such as, for example, failure of the microswitch 86 to function.

A hydraulically actuated pressure switch 89 is disposed within the hydraulic fluid line leading to the cylinders 50 and 51 so that when the pressure exceeds the level at which the switch 89 is set, the valve 81 will be activated and change the direction of flow of fluid therethrough to the opposite end of the cylinders 50 and 51, thereby causing them to extend and to swing the forming bar 27 toward its forming position. Thus, the operation of the clamping bar 26 and the forming bar 27 is synchronized, as will be more fully described hereinafter in detail.

Figure 15:
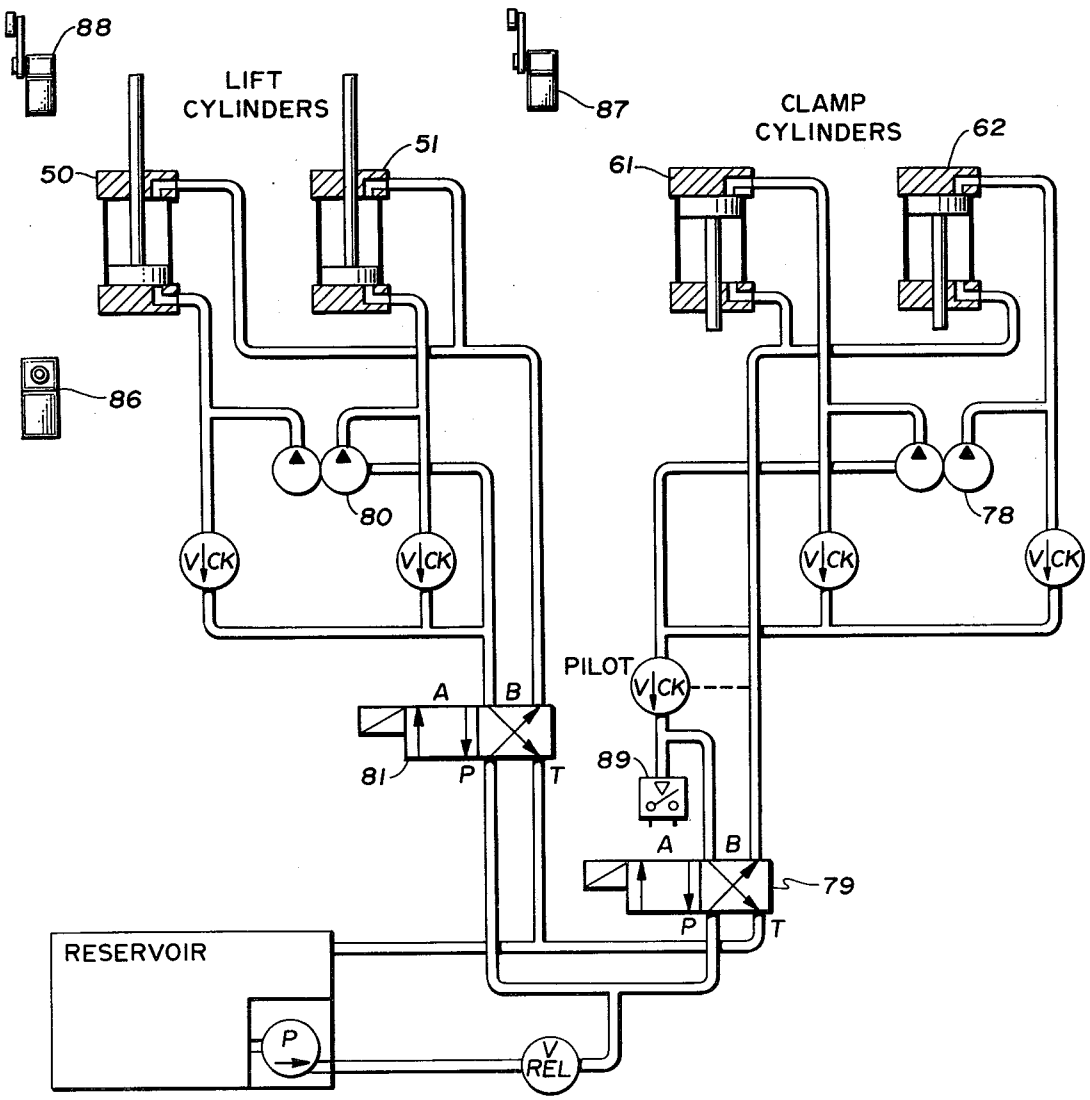
FIG. 15 is a diagrammatic illustration of the hydraulic circuit utilized in the operation of our machine.

FIG. 15 illustrates the hydraulic circuit for our machine. It will be seen by reference thereto that when valve 79 is inactivated, the hydraulic fluid passes through port B to one end of the cylinders 61 and 62 to maintain these clamping cylinders in non-elevated clamping position. When the hydraulic solenoid valve 79 is activated, the fluid is diverted to pass through port A thereof and through the flow divider 78 to opposite ends of these cylinders, thereby causing the cylinders to move the clamping bar to lowered clamping position and to maintain the same thereat until the fluid is redirected through port B of valve 79. The pressure switch 89 senses the pressure at all times within the line and moves to closed position when the predetermined pressure at which it is set is exceeded within that line. When this takes place, valve 81 is thereby activated so that the hydraulic fluid which passes through port B (while inactivated) to maintain the cylinders 50 and 51 and the forming bar 27 in lowered non-forming position, will be directed through port A and through flow divider 80 to the opposite ends of the cylinders 50 and 51. This causes the forming bar 27 to swing to forming position and to continue to swing until the angle limiting switch 86 is activated by the pad 85, which causes the valve 81 to be inactivated, so that the fluid will again be directed through port B. This causes the pistons of the cylinders 50 and 51 to move in the opposite direction, thereby lowering the gear racks connected thereto and returning the forming bar 27 to non-forming position.

Figure 16:
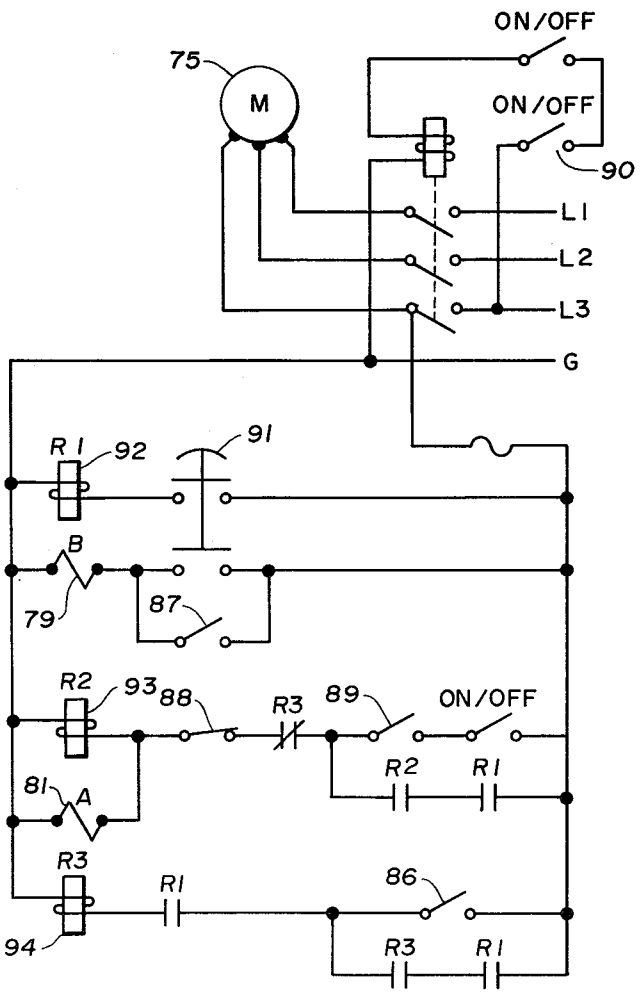
FIG. 16 is a schematic electrical wiring diagram utilized in our machine.

FIG. 16 shows a wiring diagram which controls the valves as previously described. It will be noted that there is a master switch 90, which when closed, activates the three-phase motor 75. A foot switch 91 is likewise provided. Prior to closing the foot switch 91, hydraulic fluid passes through port B of both valves 79 and 81, holding cylinders 61 and 62 in non-clamping position and cylinders 50 and 51 in retracted position so that the clamping bar 26 is elevated and forming bar 27 is in retracted position. When foot switch 91 is closed, valve 79 is activated and hydraulic fluid is caused to flow through port A through flow divider 78 to cylinders 61 and 62 to drive them to clamping position whereat the piece of sheet metal is clamped between clamping bar 26 and bed 25. At the same time relay 92 is activated, thereby closing all R-1 contact points in the circuit. When cylinders 61 and 62 bottom out, pressure is built up in the hydraulic line leading thereto, causing switch 89 to close, thereby actuating valve 81 to direct fluid through port A rather than through port B and causing cylinders 50 and 51 to extend and drive their associated gear racks and forming bar 27 to forming position. At the same time, relay 93 is activated, thereby closing all of its normally open contact points in the circuit identified as R-2. Since contact points R-2 and R-1 are in a parallel line to that in which pressure switch 89 is disposed, valve 81 will remain activated unless and until relays 92 and 93 are opened, or one of the switches 90 or 91 are opened, or one of normally closed contact points R-3 or safety switch 88 are opened.

When normally open microswitch 86 is moved to closed position by movement of the forming bar to the end of its prescribed arc, relay 94 will be activated, since contact points R-1 are closed by closing the foot switch 91. Activation of relay 94 causes normally closed contact points R-3 in the line to valve 81 to open, thereby deactivating valve 81 and relay 93, causing the fluid to flow through port B of valve 81 and forming bar 27 to be swung to retracted position. At the same time, normally open contact point R-3 in the line extending parallel to that in which microswitch 86 is located are moved to close position. Thus, relay 94 will be held in activated position until relay 92 is deactivated. This takes place, of course, when foot switch 91 is released, at which time relay 94 is deactivated. Release of foot switch 91 also causes valve 79 to be deactivated and direct the fluid flow into port B again instead of port A, thereby causing clamping cylinders 61 and 62 to move back to non-clamping position.

Microswitch 87 comes into play only when the arc of travel of forming bar 27 exceeds 90°. When this occurs, normally open switch 87 is closed and, hence, valve 79 is activated and hence fluid travels through port A and maintains cylinders 61 and 62 in clamping position. Thus, microswitch 87 ensures that the clamping bar 26 will not raise until after the returning forming bar 27 has passed the 90° or vertical position, thereby clearing the path of the clamping bar. Once the forming bar 27 swings back to less than a 90° arc, switch 87 opens and if foot switch 91 is open, valve 79 will be deactivated and fluid will flow through port B causing cylinders 61 and 62 to move clamping bar 26 to raised of non-clamping position.

Microswitch 88 is normally closed and comes into play only when the arc of travel of the forming bar 27 exceeds 135°. In that event, microswitch 88 is activated and is moved to open position, thereby deactivating valve 81, irrespective of the positions of relays 94 and 92, and causing fluid moving therethrough to again pass through port B rather than port A and move the forming bar 27 toward retracted position. This precludes the forming bar 27 from going beyond 135° in its arc of travel because of some malfunction such as, for example, failure of switch 86.

The valves 79 and 81 are each hydraulic solenoid valves of the type manufactured and sold by Parker-Hannifin, P.O. Box 129, Elyria, Ohio 44035, and are identified as a Spring Loaded ⅜ inch Solenoid Operated Directonal Valve of the 101-C Series, Model No. 101-01-BIAYC.

The flow dividers 78 and 80 are of the type identified as the P-Series Hydraulic Flow Divider, Model PM6, manufactured and sold by Delta Power Hydraulic Company, 4700 Boeing Drive, Rockford, Illinois 61109.

The pressure switch 89 is a dual snap, filed adjustable, pressure switch sold by Custom Component Switches, Inc., 21111 Plummer Street, Chatsworth, California 91311 and identified as Pressure Switch, Model No. CCS604P21. This switch is normally referred to as a pressure activated normally open microswitch.

Figure 10:
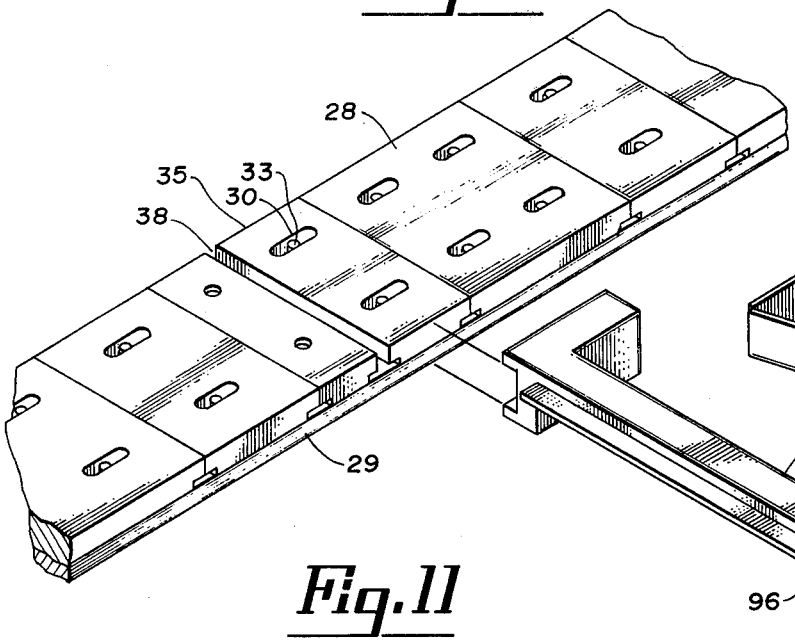
FIG. 10 is a fragmentary perspective view of a portion of the bed of our machine with portions thereof broken away and an auxiliary edge guide utilized in conjunction therewith for positioning pieces exactly for the forming operation.
Figure 13:
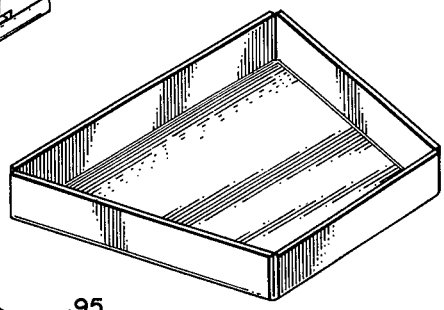
FIG. 13 is a perspective view of still another piece of sheet metal formed on our machine and illustrating the unusual configuration which may be accomplished through the use thereof.
Figure 11:
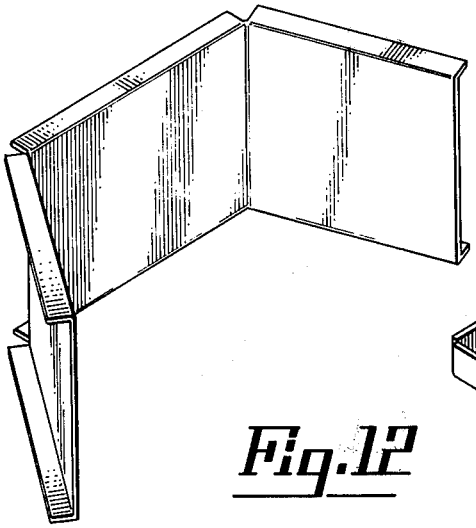
FIG. 11 is a perspective view of a piece of sheet metal formed on our machine and illustrating various types of bends, each of which may be accomplished through the use of our machine.
Figure 14:
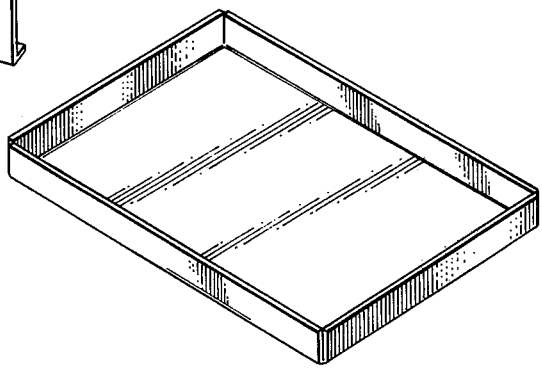
FIG. 14 is a perspectve view of a rectangular pan made upon our machine.
Figure 12:
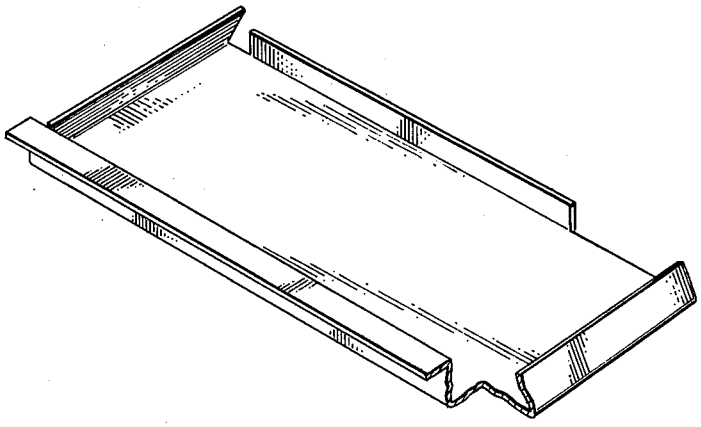
FIG. 12 is a perspective view of another piece of sheet metal with portions thereof broken away to further illustrate the type of metal forming operation which may be accomplished with our machine.

FIG. 10 shows an edge guide 95 which may be utilized in conjunction with the machine when it is desired to form the trailing edge of the sheet of metal. When this is done, the guide 95 is attached to the forward end of the spacer plates 28 and the sheet of metal is placed so as to extend along the guiding surface 96, thereby assuring that the forming action will take place at right angles to the edge 96.

FIGS. 11–14 illustrate various types of forming actions which can be accomplished through the use of our machine. It will be readily recognized by those skilled in the art that a machine which can perform such operations without the provision of specially formed dies constitutes a substantial advance over the art for it is impossible to make bends of the type shown on a single sheet of metal with conventional machines unless specially provided dies are obtained.

From the above, it can be seen that we have provided a novel and substantially improved light gauge metal forming machine through the use of which many forming operations can be accomplished without the need for specially designed dies as heretofore required. As a result, our metal forming machine has substantially greater versatility than others heretofore known.

It will be noted that with our machine, it is possible to produce a particular bend or metal forming operation upon a large number of sheets of metal semi-automatically and within a relatively short period of time. This is accomplished by first placing the sheet of metal in the desired position so that the line along which the forming operation is to be performed is directly above the breaking edge and then pressing foot switch 91 which causes the clamping bar 26 to descend and clamps the sheet of metal between the clamping fingers and the selected spacer plate 28. Immediately thereafter, the forming bar 27 will automatically swing upwardly throughout the full extent of its predetermined arc which has been selected by the operator by making the desired adjustment of the angle indicator 82. As previously described, the forming bar 27 returns to its retracted position automatically upon reaching the end of its predetermined arc of travel and thereafter, the clamping plate 26 will be raised upon release of the foot switch 91. Immediately thereafter, a second sheet of metal may be placed in the desired position and the semi-automatic operation repeated. As a consequence, a relatively large number of sheets of sheet metal may be formed identically within a short period of time. Moreover, when it is so desired, it is a simple matter to adjust the angle indicator 82 to produce semi-automatic forming of any desired number of sheets at a different angle. Also, a large variety of different types of forming operations can be accomplished by proper selection and use in combination of clamping fingers of desired widths, of spacer plates 28 of desired widths, and of forming finger 56 of desired positions and widths.

It will also be noted that it is a simple matter to utilize our machine for hemming operations only. This can be accomplished simply by the operator opening the normally closed on/off switch which is included in the electrical line leading to valve 81 and relay 93, as shown in FIG. 16. When this switch is open, then the control bar 26 can be operated repeatedly with the foot switch 91 to perform hemming operations.

Thus, it can be seen that we have provided novel and improved methods and machine for performing desired sheet metal forming operations frequently needed in the shop but for which special dies have heretofore been required in order to achieve their accomplishment. The versatality of this machine and of these methods provides a substantial saving in time, labor and equipment.

It will, of course, be understood that various changes may be made in the form, details, arrangement and proportions of the parts without departing from the scope of our invention which sonsits of the matter shown and described herein and set forth in the appended claims.

We claim:

1. A sheet metal forming machine comprising:

(a) a rigid frame;

(b) a bed fixedly carried by said frame and having a breaking edge at the forward end thereof;

(c) a clamping bar movably mounted upon said frame for movement between clamping and non-clamping position relative to said bed for clamping a sheet of metal therebetween along said breaking edges and having an underside surface;

(d) an elongated mounting channel extending longitudinally of said clamping bar and formed in its said underside surface and having vertically extending side walls;

(e) said clamping bar including a plurality of clamping fingers of various widths each having an upstanding mounting bar extending upwardly thereabove constructed and arranged to be laterally slidable and removably received within said channel to support its associated clamping finger upon said bar for universal sliding adjustment longitudinally of said channel along said breaking edge;

(f) the forward ends of said clamping fingers terminating co-planar with said breaking edge of said bed when so mounted within said channel;

(g) horizontally adjustable mechanical securing means carried by said clamping bar opposite said channel and extending thereinto transversely of its side walls for securing said mounting bars of said clamping fingers in desired position within said channel; and (h) a forming bar pivotally mounted on said frame for close pivotal arcuate movement around said clamping bar fingers and the breaking edge of said bed for cooperative forming of such a sheet of metal therebetween.

2. The structure defined in claim 1 wherein (i) said channel is defined in part by a wall disposed oppositely relative to said securing means and which extends from said underside surface of said clamping bar upwardly and away from said securing means, and has an opposite wall through which said securing means extends into said channel; and (j) the upstanding mounting bar of each of said clamping fingers has a rear side wall extending upwardly and away relative to the forward end of its associated finger and is complementary to and adapted to cooperatively engage said first mentioned channel wall.

3. The structure defined in claim 1 wherein (i) the minimum transverse width of said channel is slightly greater than the maximum transverse width of each of said mounting bars whereby the latter may be readily inserted into or removed from said channel when said securing means is withdrawn from said channel.

4. The structure defined in claim 1 wherein (i) said clamping bar and said forming bar are hydraulically actuated in synchronism with each other to automatically activate said forming bar upon movement of said clamping bar into clamping position with said bed.

5. A sheet metal forming machine comprising:

(a) a rigid frame;

(b) a bed fixedly carried by said frame and having a breaking edge at the forward end thereof;

(c) said bed including a plurality of laterally shiftable spacer plates of various widths fixedly secured to said frame in side by side parallel but slightly spaced relation and defining a channel between adjacent pairs thereof extending normal to said breaking edge;

(d) said spacer plates having forward ends terminating along a single plane and together defining said breaking edge;

(e) a clamping bar movably mounted upon said frame for movement between clamping and non-clamping positions relative to said bed for clamping a sheet of metal therebetween along said breaking edge; and (f) a forming bar pivotally mounted on said frame for close pivotal arcuate movement around said clamping bar and the breaking edge of said bed for cooperatively forming such a sheet of metal therebetween.

6. The structure defined in claim 5 wherein (g) said clamping bar carries a clamping finger assembly including at least one clamping finger, said clamping finger having a forward end terminating immediately above said breaking edge of said bed when said clamping bar is moved to clamping position and being carried in position to cooperate with said bed across the span of at least one of said spacer plates.

7. The structure defined in claim 5 wherein (g) said clamping bar carries a clamping finger assembly positioned and adjustably dimensioned so that the width thereof is substantially coextensive with the width of one of said spacer plates.

8. The structure defined in claim 5 wherein (g) said clamping bar carries a clamping finger assembly positioned and adjustably dimensioned so that the width thereof is substantially coextensive with the combined width of a plurality of said spacer plates.

9. The structure defined in claim 5 wherein some of said spacer plates are of different widths and all are laterally shiftable and removably secured to said frame, and are interchangeable.

10. The structure defined in claim 5 and (g) a bed gauge slidably mounted within said channel between said spacer plates to facilitate proper positioning of a sheet of metal upon said bed preparatory to forming the same, and constructed and arranged to be adjustably positioned and fixed at any desired position along the length of said bed.

11. The structure defined in claim 5 wherein (g) said clamping bar and said forming bar are hydraulically actuated semi-automatically in synchronized relation with each other to automatically activate said forming bar upon movement of said clamping bar into clamping position with said bed.

12. The structure defined in claim 5 wherein (g) said bed and its fixedly mounted spacer plates are constructed and arranged to permit the latter to have their position adjusted laterally within predetermined limits.

13. A sheet metal forming machine comprising:

(a) a rigid frame;

(b) a bed comprised of laterally shiftable spacer plates fixedly carried by said frame and having a breaking edge at the forward end thereof;

Ic) a clamping bar movably mounted upon said frame for movement between clamping and non-clamping positions relative to said bed for clamping a sheet of metal therebetween along said breaking edge; and (d) a forming bar pivotally mounted on said frame for close pivotal arcuate movement around said clamping bar and the breaking edge of said bed for cooperatively forming such a sheet of metal therebetween;

(e) said forming bar including a plurality of forming fingers of various widths removably mounted thereon and moving therewith around said breaking edge in position to cooperate with said bed and said clamping bar in the forming action on such a sheet of metal.

14. The structure defined in claim 13 wherein (f) said clamping bar includes at least one clamping finger having a combined width substantially coextensive with the combined width of said forming finger carried by said forming bar and being disposed in aligned relation therewith; and (g) said bed includes at least one laterally shiftable spacer plate fixedly secured in aligned relation with said clamping finger and said forming fingers and having a forward end terminating along the ends of said clamping finger and said forming fingers and defining said breaking edge.

15. The structure defined in claim 14 wherein (h) said clamping bar includes a plurality of said clamping fingers which are laterally shiftable; and (i) said clamping fingers, spacer plates and forming fingers are aligned with each other and are substantially coextensive in width.

16. The structure defined in claim 14 wherein (h) said clamping bar includes a plurality of said clamping fingers;

(i) said bed includes a plurality of said spacer plates; and (j) said clamping fingers, spacer plates, and forming fingers are aligned with each other and are substantially coextensive in width.

17. The structure defined in claim 14 wherein (h) said clamping bar includes at least one clamping finger carried by said forming bar in position to cooperatively clamp a sheet of metal with said bed along said breaker line;

(i) said bed includes a plurality of said spacer plates of various widths, and (j) said clamping finger, spacer plates, and forming fingers are aligned with each other and are substantially coextensive in width.

18. The structure defined in claim 13 wherein said clamping bar and said forming bar are constructed and arranged to be hydraulically actuated in synchronism with each other to automatically activate said forming bar upon movement of said clamping bar into clamping position with said bed.

19. The structure defined in claim 13 wherein said clamping bar and said forming bar are constructed and arranged to be semi-automatically hydraulically actuated in synchronism with each other to automatically activate said forming bar upon movement of said clamping bar into clamping position with said bed.

20. The structure defined in claim 5 wherein said clamping bar and said forming bar are each hydraulically operated, and (g) hydraulic control means connected to said clamping bar and said forming bar in movement controlling relation and synchronizing the movements thereof with each other to automatically activate said forming bar upon movement of said clamping bar into clamping position with said bed.

21. The structure defined in claim 20 wherein at least part of said control means is electrically activated, and (g) electrical means connected to said control means in activating relation for semiautomatic repeated movement of said clamping bar and said forming bar relative to each other whereby the same metal forming operation may be repeatedly performed in sequence upon a plurality of sheets of metal.

22. The structure defined in claim 21, and (g) adjustable control means connected with the pivotal mounting of said forming bar and controlling the extent of arc of movement thereof around said clamping bar and said breaking edge of said bed whereby said forming bar may be so moved repeatedly in rapid sequence to perform the same sheet metal forming operation at a predetermined slected angle upon a plurality of sheets.

23. The method of forming a sheet of light gauge metal having a flat central area to be formed consisting in:

(a) selecting a plurality of laterally shiftable spacer plates of various widths and affixing same to a bed to comprise a combined bed spacer plate having a width substantially equal to but no greater than the width of the central area of the sheet;

(b) placing the sheet upon the combined bed spacer plate;

(c) clamping the central area of the sheet upon the spacer plate with at least one clamping finger having a combined clamping width substantially equal to but no greater than the width of the central area of the sheet with the end of the clamping finger directly opposite the end of the spacer plate and along the line at which it is desired to form the sheet; and (d) bending the sheet of metal along the line about the end of the clamping finger to a desired angle with a forming bar having a forming surface substantially equal in width to the clamping width of the clamping finger.

24. The method of forming a sheet of light gauge metal having a flat central area to be formed consisting in:

(a) selecting a plurality of interchangeable bed spacer plates of various widths and moving and affixing same upon a bed into adjacent positions to comprise a combined bed spacer plate having a desired combined width substantially equal to but no greater than the width of the central area to be formed and having a breaking edge at one end thereof;

(b) placing the central area of the sheet upon the spacer plates in position so that the breaking edge of the plates will extend along the line at which it is desired to form the sheet;

(c) selecting one or more clamping fingers having a combined width substantially equal to but no greater than the combined width of the spacer plates;

(d) cooperatively clamping the sheet of metal between said spacer plates and the end of the clamping fingers directly opposite the breaking edge of the spacer plates;

(e) selecting one or more forming fingers having a a combined width substantially equal to the combined width of the spacer plates; and (f) pivotally moving the forming fingers about the breaking edge of the spacer plates and about the clamping fingers in close cooperative metal-forming relation to cooperatively form the sheet of metal to a desired angle about the desired line.

* * * * *

UNITED STATES PATENT AND TRADEMARK OFFICE

CERTIFICATE OF CORRECTION

PATENT NO. : 4,112,731

DATED : September 12, 1978

INVENTOR(S) : Leroy E. Anderson, et al.

It is certified that error appears in the above-identified patent and that said Letters Patent are hereby corrected as shown below:

Column 10, Line 19, delete "Ic)", and insert --(c)--.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*